United States Patent [19]

Fox

[11] Patent Number: 4,561,766

[45] Date of Patent: Dec. 31, 1985

[54] BLADE CLEANER APPARATUS FOR REMOVING TONER FROM A CHARGE-RETENTIVE SURFACE

[75] Inventor: Wayne D. Fox, Rochester, N.Y.

[73] Assignee: Xerox Corporation, Stamford, Conn.

[21] Appl. No.: 623,592

[22] Filed: Jun. 22, 1984

[51] Int. Cl.[4] ..... G03G 15/00

[52] U.S. Cl. ..... 355/15; 355/3 R; 15/256.5; 15/256.51

[58] Field of Search ..... 355/15, 3 R, 3 DD, 14 D; 15/256.5, 256.51

[56] References Cited

U.S. PATENT DOCUMENTS

| | | | |
|---|---|---|---|
| 4,140,388 | 2/1979 | Ikesue | 355/15 |
| 4,165,965 | 8/1979 | Bernardelli et al. | 355/15 X |
| 4,218,132 | 8/1980 | Iwai et al. | 355/15 |
| 4,219,270 | 8/1980 | Weikel, Jr. et al. | 355/15 X |
| 4,314,756 | 2/1982 | Amitani et al. | 355/15 |
| 4,357,098 | 11/1982 | Endo | 355/15 |
| 4,426,151 | 1/1984 | Aguro et al. | 355/15 |

OTHER PUBLICATIONS

Xerox Pending Patent Application Ser. No. 527,160, entitled "Blade Cleaner for Charge-Retentive Surface", filed 8/29/83 in the name of John E. Viniski.

*Primary Examiner*—A. C. Prescott

[57] ABSTRACT

Blade cleaner apparatus for removing residual toner from a charge-retentive surface including a cleaner housing having a cleaning blade disposed therein adjacent the top thereof. The apparatus is characterized by improved means for reducing the escape of toner particles from the housing. To this end, a shield is mounted behind the blade, out of contact from the blade and the surface to be cleaned. The shield directs toner propelled by the blade in a generally downward direction. A lower seal supported by the cleaner housing contacts the surface to be cleaned and insures that the toner stays in the cleaner housing. The lower seal is characterized by its ease of attachment to the cleaner housing. Accordingly, one end of the seal is bent so that an outer angle is formed. The material from which the seal is fabricated is flexible so that the end can be manipulated such as to reduce the acute angle to allow resuction into a recess in the housing.

12 Claims, 3 Drawing Figures

BLADE CLEANER APPARATUS FOR REMOVING TONER FROM A CHARGE-RETENTIVE SURFACE

This invention relates to printing machines, and more particularly, to a blade cleaner apparatus for removing residual toner from a charge-retentive surface utilized therein.

In printing arts of the type contemplated, a charge-retentive surface such as a photoconductor which comprises a photoconductive insulating material adhered to a conductive backing is charged uniformly. Then the photoreceptor is exposed to a light image of an original document to be reproduced. The latent electrostatic images, thus formed, are rendered visible by applying any one of numerous pigmented resins specifically designed for this purpose. In the case of a reusable photoreceptor, the pigmented resin, more commonly referred to as toner which forms the visible images is transferred to plain paper. After transfer, toner images are made to adhere to the copy medium usually through the application of heat and pressure by means of a roll fuser.

Although a preponderance of the toner forming the images is transferred to the paper during transfer, some toner remains on the photoreceptor surface, it being held thereto by relatively high electrostatic and/or mechanical forces. It is essential for optimum operation that the toner remaining on the surface be cleaned thoroughly therefrom.

An example of a cleaner that has become commercially successful is the blade cleaner. Blade cleaners have become quite popular in recent years due to their simplicity in construction, and their high degree of effectiveness in residual toner removal. When a cleaning blade is positioned above the surface to be cleaned, the toner rapidly builds into a pile in front of the blade which traps and agglomerates the toner particles thereby precluding undesirable powder clouding. However, removal of the toner away from the charge-retentive surface thus accumulated is more difficult than when the blade is positioned below the photoreceptor or adjacent a vertical section thereof. In these locations, however, toner is propelled away from the blade in a fan-like pattern. Air flowing in the vicinity of the toner propelled away from the blade in such a pattern can carry the toner into other parts of the machine.

The aforementioned problem is at least minimized by the present invention through the provision of a shield which is carried by the blade holder and extends beyond the end and to one side of the blade. The shield suppresses the fanning action of the toner as it is propelled from the blade thus causing the toner to be directed downwardly into a cleaner housing. A lower seal member secured to the cleaner housing serves to preclude toner from exiting the housing through a space between the charge-retentive surface and the cleaner housing. The lower seal is characterized by its construction which allows it to be readily attached to the cleaner housing.

A cleaning blade and shield therefor are disclosed in U.S. patent application Ser. No. 527,160 filed on Aug. 29, 1983 and assigned to the same assignee as the present invention. There the shield member, unlike the shield member of the instant invention, physically contacts both the charge-retentive surface and the blade. These differences provide an improved cleaner, in that the shield neither impedes the desirable downward movement of the toner nor does it adversely affect proper operation of the blade.

Other aspects of the present invention will become apparent as the following description proceeds with reference to the drawings.

Inasmuch as the art of electrophotographic printing is well known, the various processing stations employed in the printing machine illustrated in FIG. 1 will be described only briefly.

Figure 1:
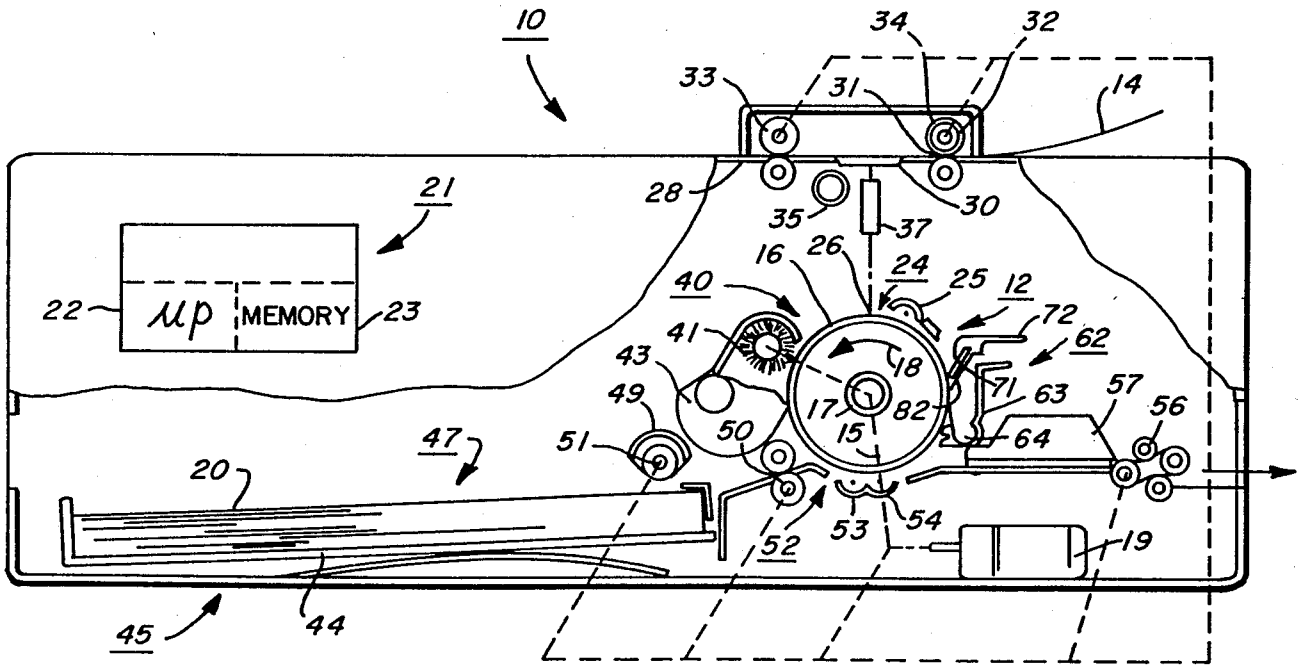
FIG. 1 is a schematic elevational view depicting an electrophotographic printing machine incorporating the present invention.

Referring to FIG. 1 of the drawings, there is shown by way of example an automatic xerographic reproduction or printing machine, designated generally by the numeral 10 incorporating the cleaner apparatus of the present invention.

The reproduction machine 10 depicted in FIG. 1 illustrates the various components utilized in machines of this type for producing copies of a document original 14. Although the cleaner apparatus of the present invention is particularly well adapted for use in reproduction machines 10, it should become evident from the following description that it is equally well suited for use in a wide variety of other reproduction and printing machine types and systems and is not necessarily limited in application to the particular embodiment or embodiments shown herein.

Reproduction machine 10 has an image recording photoreceptor or any suitable charge-retentive surface 15 in the form of a drum, the outer periphery of which has a suitable photoconductive material 16. Photoreceptor 15 is suitably journaled for rotation within the machine frame (not shown) as by means of shaft 17. A main drive motor 19 is drivingly coupled to photoreceptor 15, motor 19 photoconductive surface 16 of photoreceptor 15 past a series of xerographic processing stations. A suitable controller 21 with microprocessor 22 and memory 23 is provided for operating in a predetermined timed relationship with various components that comprise machine 10 to reproduce the document original 14 upon a sheet of final support material such as copy sheet 20. As will be understood by those familiar with the art, memory 23 may comprise suitable read only memory (ROM), random access memory (RAM), and/or non-volatile memory (NVM), memory 23 serving to store the various operating parameters for reproduction machine 10 and the copy run information programmed by the machine user or operator.

Initially, the photoconductive surface 16 of photoreceptor 15 is uniformly charged by a suitable charging device such as scorotron 25 at charging station 24. The uniformly charged photoconductive surface 16 is exposed at exposure station 26 to create a latent electrostatic image of the document original 14 on photoreceptor 15. For this purpose, a suitable supporting surface or platen 28 for document original 14 is provided having a scan aperture or slit 30 therethrough. A suitable document transport, depicted herein as inlet and outlet constant velocity roll pairs 32, 33 is provided for transporting the document original past scan slit 30. Roll pairs 32, 33 are drivingly coupled to main drive motor 19, roll pair 32 being coupled through an electromagnetically operated clutch 34. A suitable document sensor 31 is provided at the inlet to platen 28 for sensing the insertion of document original 14 to be copied and initiating operation of the reproduction machine 10.

A lamp 35, which is disposed below platen 28, serves to illuminate scan slit 30 and the line-like portion of the document original 14 thereover. A suitable fiber optic type lens array 37 which may, for example, comprise an array of gradient index fiber elements, is provided to optically transmit the image rays reflected from the line-like portion of the document original being scanned to the photoconductive surface 16 of photoreceptor 15 at exposure station 26.

Following exposure, the latent image on the photoconductive surface 16 of photoreceptor 15 is developed at a development station 40. There, a suitable developer such as magnetic brush roll 41, which is drivingly coupled to main drive motor 19, brings a suitable developer mix in developer housing 43 into developing relation with the latent image to develop the image and render the same visible.

Copy sheet 20 are supported in stack-like fashion on base 44 of copy sheet supply tray 45. Suitable biasing means are provided to raise base 44 of tray 45 and bring the topmost copy sheet 20 in the stack of sheets 47 into operative relationship with segmented feed rolls 49. Feed rolls 49 are driven by main drive motor 19 through an electromagnetically operated clutch 51. Rolls 49 serve upon actuation of clutch 51 to feed the topmost copy sheet forward into the nip of a registration roll pair 50 which register the copy sheet with the image on the photoconductive surface 16 of photoreceptor 15. Registration roll pair 50 advances the copy sheet to transfer station 52. There, suitable transfer/detack means such as transfer/detack corotrons 53, 54 bring the copy sheet into transfer relation with the developed image on photoconductive surface 16 and separate the copy sheet therefrom for fixing and discharge as a finished copy.

Following transfer station 52, the image bearing copy sheet is transported to fuser 57, which may, for example, comprise a radiant type fuser, where the image is permanently fixed to the copy sheet. Following fusing, the finished copy is transported by roll pair 56 to a suitable receptacle such as an output tray (not shown). Registration roll pair 50 and transport roll pair 56 are driven by main drive motor 19 through suitable driving means such as belts and pulleys.

Following transfer, residual developer remaining on the photoconductive surface 16 of photoreceptor 15 is removed at cleaning station 62 by means of cleaning apparatus 63. Developer removed by cleaning apparatus 63 is deposited into a suitable collector or cleaner housing 64 for removal.

While a drum type photoreceptor is shown and described herein, it will be understood that other photoreceptor types may be employed such as belt, web, etc.

To permit effective and controlled charging of the photoconductive surface 16 by scorotron 25 to a predetermined level necessitates that any suitable charges on the photoconductive surface 16 or trapped in the photoreceptor bulk be removed prior to charging. An erase device, not shown, is provided for this purpose.

Figure 2:
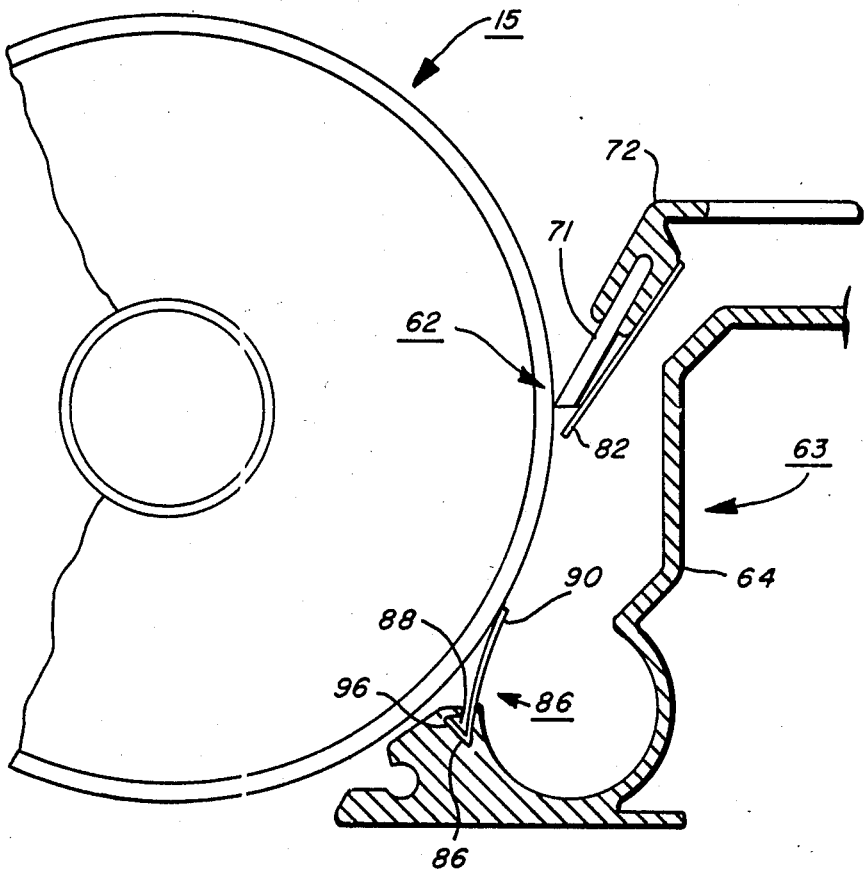
FIG. 2 is an enlarged fragmentary view of a cleaner apparatus representing the invention.
Figure 3:
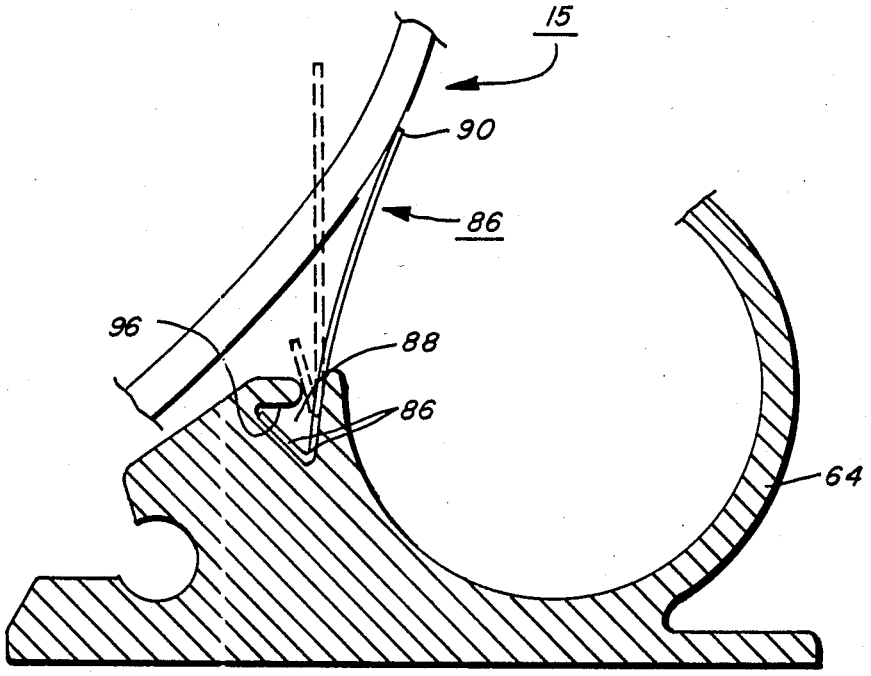
FIG. 3 is an enlarged fragmentary view of a lower seal forming a part of the cleaner apparatus of FIG. 2.

As disclosed in FIGS. 2 and 3, the cleaning apparatus 63 comprises a blade holder 72 having a groove or slot into which a conventional cleaning blade 71 is inserted. The holder is mounted to a machine frame member (not shown) such that the blade edge contacts the photoreceptor surface in the manner shown. A shield 82 also carried by the holder 72 extends beyond the edge of the blade and as illustrated falls short of contacting the photoreceptor. This arrangement of the shield and blade suppresses the wide fan pattern that would otherwise result, absent the shield, and channels the toner propelled by the cleaning blade in a downwardly direction. Two important aspects of the shield mounting are that it does not contact the charge-retentive surface and it does not contact the blade.

A lower seal 86 preferably fabricated from Mylar, a trademark of E. I. DuPont, is provided to insure that the falling toner does not escape through the space between the charge-retentive surface and the collector. An end 87 of the lower seal 86 mounts in a recess 88 provided in the cleaner housing 64 while the other end 90 lightly (i.e. toner on the surface can pass under it without being removed) contacts the surface of the photoreceptor 15. A 0.001 inch thick sheet of Mylar has proven satisfactory for this purpose. The light contact pressure also minimizes the abrasion of the photoconductor. To facilitate installation of the seal 86, it is provided with a snap-in feature by forming the end 90 in the shape of an acute angle. The seal material is sufficiently flexible that the size of the acute angle can be reduced pursuant to installing the end 90 into the recess 88. After it is received in the recess, the end 90 resumes it original shape whereby the tip 94 edge thereof becomes captivated by a lip or flange 96 partially delineating the recess.

I claim:

1. Cleaner apparatus for removing residual toner from a charge-retentive surface, said apparatus comprising:

a housing;

a blade holder in said housing;

a blade member supported within said housing by said blade holder; and means supported within said housing adjacent said blade but not contacting it for causing said toner to fall in a generally downward direction toward the bottom of said housing.

2. Apparatus according to claim 1 wherein said means for causing said toner to fall is supported by said blade holder.

3. Apparatus according to claim 2 including a lower seal carried by the bottom of said housing and lightly contacting said charge-retentive surface to preclude escape of toner.

4. Apparatus according to claim 3 wherein said lower seal comprises a thin plastic member having an angulated end which is collapsible for being received in a recess in said housing, after which it expands to become locked in said recess.

5. Apparatus according to claim 2 wherein said means for causing said toner to fall comprises a thin shield member.

6. Printing apparatus comprising:

a charge-retentive surface;

means including toner for forming visible images on said charge-retentive surface;

a housing;

a blade holder in said housing;

a blade member supported within said housing by said blade holder; and means supported within said housing adjacent said blade but not contacting it for causing said toner to fall in a generally downward direction toward the bottom of said housing.

7. Apparatus according to claim 6 wherein said means for causing said toner to fall is supported by said blade holder.

8. Apparatus according to claim 7 including a lower seal carried by the bottom of said housing and lightly contacting said charge-retentive surface to preclude escape of toner.

9. Apparatus according to claim 8 wherein said lower seal comprises a thin plastic member having an angulated end which is collapsible for being received in a recess in said housing, after which it expands to become locked in said recess.

10. Apparatus according to claim 9 wherein said means for causing said toner to fall comprises a thin shield member.

11. Apparatus according to claim 2, wherein said means for causing said toner to fall comprises a thin shield member.

12. Apparatus according to claim 11 wherein said thin shield member extends slightly beyond the end of said blade toward said charge-retentive surface but does not contact it.

* * * * *